US011957288B1

(12) United States Patent
Huang

(10) Patent No.: US 11,957,288 B1
(45) Date of Patent: Apr. 16, 2024

(54) DOUBLE-TANK WATER SPRAYING MOP

(71) Applicant: Shenzhen Yuexiangshang Technology Co., Ltd., Shenzhen (CN)

(72) Inventor: Yongge Huang, Cixi (CN)

(73) Assignee: Shenzhen Yuexiangshang Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/242,463

(22) Filed: Sep. 5, 2023

(30) Foreign Application Priority Data

Sep. 22, 2022 (CN) ..... 202222513288.5

(51) Int. Cl.
*A47L 13/22* (2006.01)
*A47L 13/254* (2006.01)
*A47L 13/42* (2006.01)

(52) U.S. Cl.
CPC ..... *A47L 13/22* (2013.01); *A47L 13/254* (2013.01); *A47L 13/42* (2013.01)

(58) Field of Classification Search
CPC ..... A47L 13/42; A47L 11/4083; A47L 13/20; A47L 13/22–258
USPC ..... 401/138, 139
See application file for complete search history.

(56) References Cited

U.S. PATENT DOCUMENTS

2017/0127903 A1* 5/2017 Grandstrand ..... A47L 11/4086

FOREIGN PATENT DOCUMENTS

| | | | | |
|---|---|---|---|---|
| CN | 204207689 U | | 3/2015 | |
| CN | 204931597 U | | 1/2016 | |
| CN | 106343932 A | | 1/2017 | |
| CN | 106580207 A | * | 4/2017 | ..... A47L 13/22 |
| WO | WO-2017024694 A1 | * | 2/2017 | ..... A47L 13/22 |

OTHER PUBLICATIONS

WIPO Translate WO-2017024694-A1; Multi-Bottle Liquid Spray Mop; Cheng, D; Dec. 23, 2015 (Year: 2015).*
WIPO Translate CN-106580207-A; Spraying Mop; Li, Jing; Apr. 26, 2017 (Year: 2017).*

* cited by examiner

*Primary Examiner* — Laura C Guidotti
*Assistant Examiner* — Sidney D Full
(74) *Attorney, Agent, or Firm* — George D. Morgan

(57) ABSTRACT

A double-tank water spraying mop, comprising a mop rod, a water tank housing, a first water tank, a second water tank, a water pump, a nozzle, and a distribution body, wherein the first water tank, the second water tank, the water pump, the nozzle and the distribution body are located in the water tank housing, the water pump is connected to the nozzle, after the water pump is started, the liquid entering the water pump from the first and second water tanks may be sprayed out through the nozzle; a distribution valve is further arranged in the distribution body, and under the distribution of the distribution valve, the liquid in the first water tank and the second water tank may flow into the water pump through the distribution body.

3 Claims, 11 Drawing Sheets

DOUBLE-TANK WATER SPRAYING MOP

CROSS-REFERENCE TO RELATED APPLICATIONS

The application claims priority to Chinese patent application No. 202222513288.5, filed on Sep. 22, 2022, the entire contents of which are incorporated herein by reference.

TECHNICAL FIELD

The present invention relates to a double-tank water spraying mop.

BACKGROUND

A water-spraying mop with two water tanks is disclosed in CN 04983374 A, which can hold different liquids, for example, one tank holds water and the other tank holds cleaning liquid. In this patent application, in order to achieve the purpose of selecting a spray solution, a rotating valve core is installed on the water tank, which is used to selectively communicate with a water tank. The disadvantage of the double-tank water spraying mop is that the rotation degree of the rotating valve core is difficult to control, which is not conducive to rotation operation; it is difficult for users to determine which water tank is currently in use.

SUMMARY

In order to overcome the above shortcomings of the existing double-tank water spraying mop, a double-tank water spraying mop that is easy to operate is provide according to the present invention.

Further, a double-tank water spraying mop which is convenient for determining the currently used water tank is provided according to the present invention.

The technical scheme for solving the technical problems of the present invention is as follows: a double-tank water spraying mop, including a mop rod, a water tank housing, a first water tank, a second water tank, a water pump, a nozzle, and a distribution body, the first water tank, the second water tank, the water pump, the nozzle and the distribution body are located in the water tank housing, the water pump is connected to the nozzle, after the water pump is started, the liquid entering the water pump from the first and second water tanks may be sprayed out through the nozzle;

A first groove and a second groove are defined at an upper end of the distribution body, a water outlet end of the first water tank is placed in the first groove, and a water outlet end of the second water tank is placed in the second groove, and the water pump is connected with a lower part of the distribution body;

A distribution valve is further arranged in the distribution body, and under the distribution of the distribution valve, the liquid in the first water tank and the second water tank may flow into the water pump through the distribution body, wherein:

the distribution body is provided with a valve stem cavity, a bottom surface of the first groove is provided with a first liquid inlet for communicating the first groove with the valve stem cavity, and a bottom surface of the second groove is provided with a second liquid inlet for communicating the second groove with the valve stem cavity. A bottom surface of the distribution body is provided with a first liquid outlet and a second liquid outlet which are opposite to the first liquid inlet and the second liquid inlet respectively. A lower end of the distribution body is connected to a connecting body, which is connected to the water pump; the connecting body is provided with a liquid passing cavity, the first liquid outlet and the second liquid outlet are communicated with the liquid passing cavity, and the liquid passing cavity is communicated with the water pump;

The distribution valve includes a valve stem and an operation block connected to both ends of the valve stem, which is exposed out of the water tank housing, the valve stem is provided with a first channel close to the first water tank and a second channel close to the second water tank, the valve stem penetrates through the valve stem cavity, the valve stem slides and communicates the first liquid inlet with the first liquid outlet through the first channel, or communicates the second liquid inlet with the second liquid outlet through the second channel.

Furthermore, a first limit block is arranged on the operation block close to the first channel, and a second limit block is arranged on the operation block close to the second channel;

In case that the valve stem slides until the first limit block abuts against the distribution body, the second channel communicates the second liquid inlet with the second liquid outlet, the operation block with the second limit block protrudes out of the water tank housing; in case that the valve stem slides until the second limit block abuts against the distribution body, the first channel communicates the first liquid inlet with the first liquid outlet, the operation block with the first limit block protrudes out of the water tank housing.

Further, an embedded groove is defined on the operation block, and the two ends of the valve stem are provided with embedded blocks, and the embedded blocks slide into the embedded groove.

Further, a rear part of the distribution body is further provided with a rod connecting sleeve, and the mop rod is inserted into the rod connecting sleeve.

The beneficial effects of the present invention are: 1, the use of sliding valve stems for liquid outlet adjustment makes operation more convenient; 2, the currently used water tank may be determined according to the different situations that the operating blocks at both ends protrude out of the water tank housing.

DETAILED DESCRIPTION OF THE EMBODIMENTS

The present invention is further described in detail with reference to the attached drawings and specific embodiments.

Figure 1:
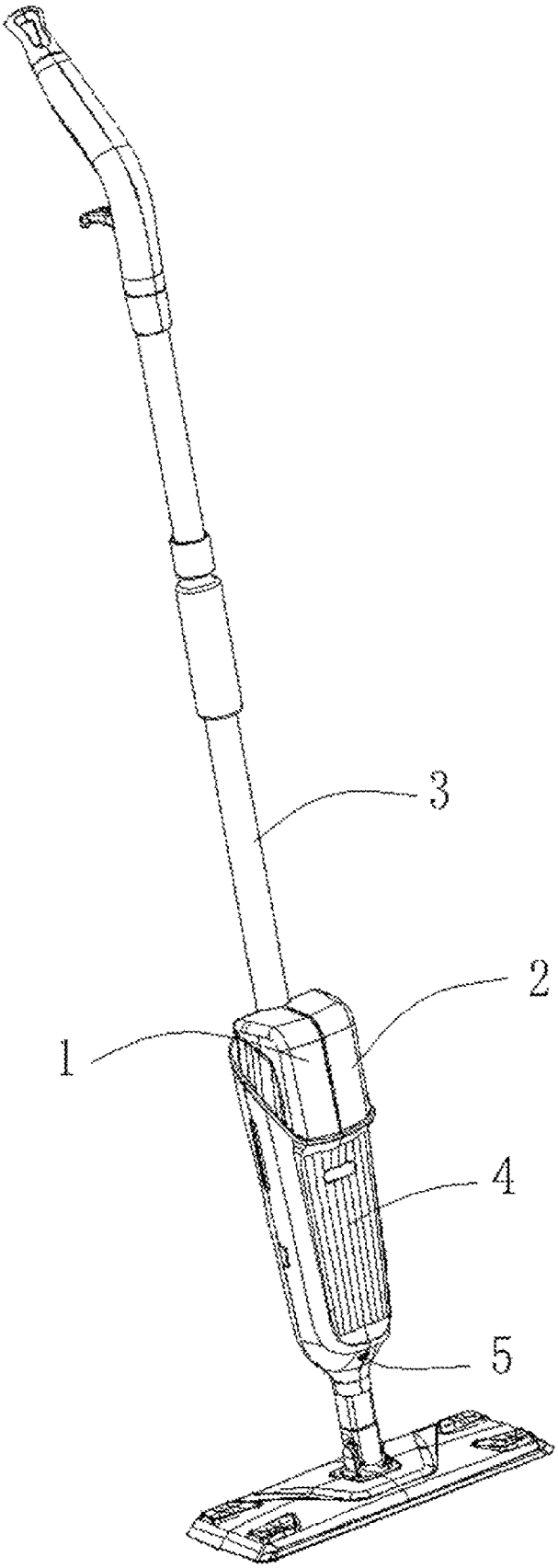
FIG. 1 is a schematic structural diagram of the present invention.
Figure 2:
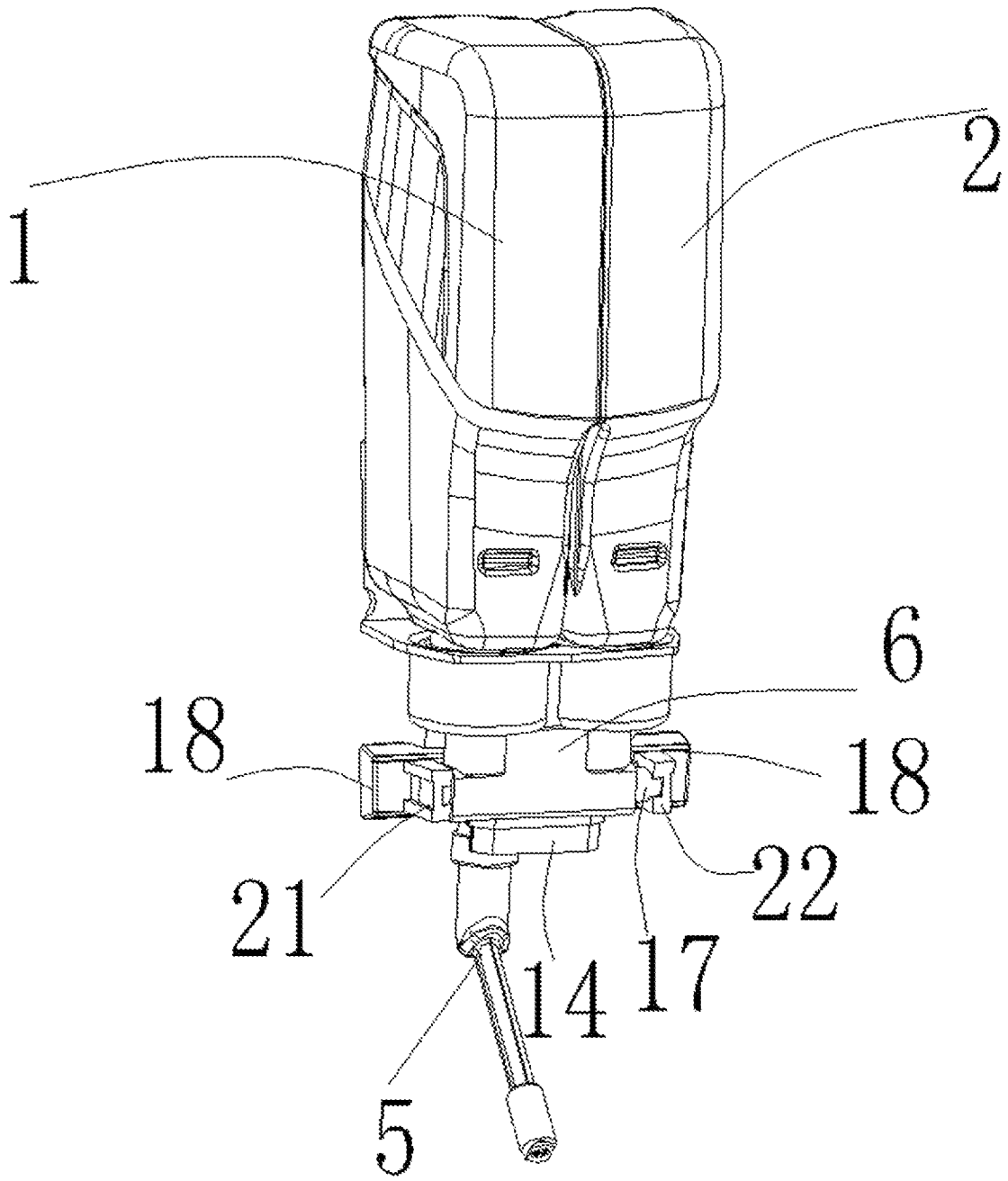
FIG. 2 is an internal structure diagram of a water tank of the present invention.
Figure 3:
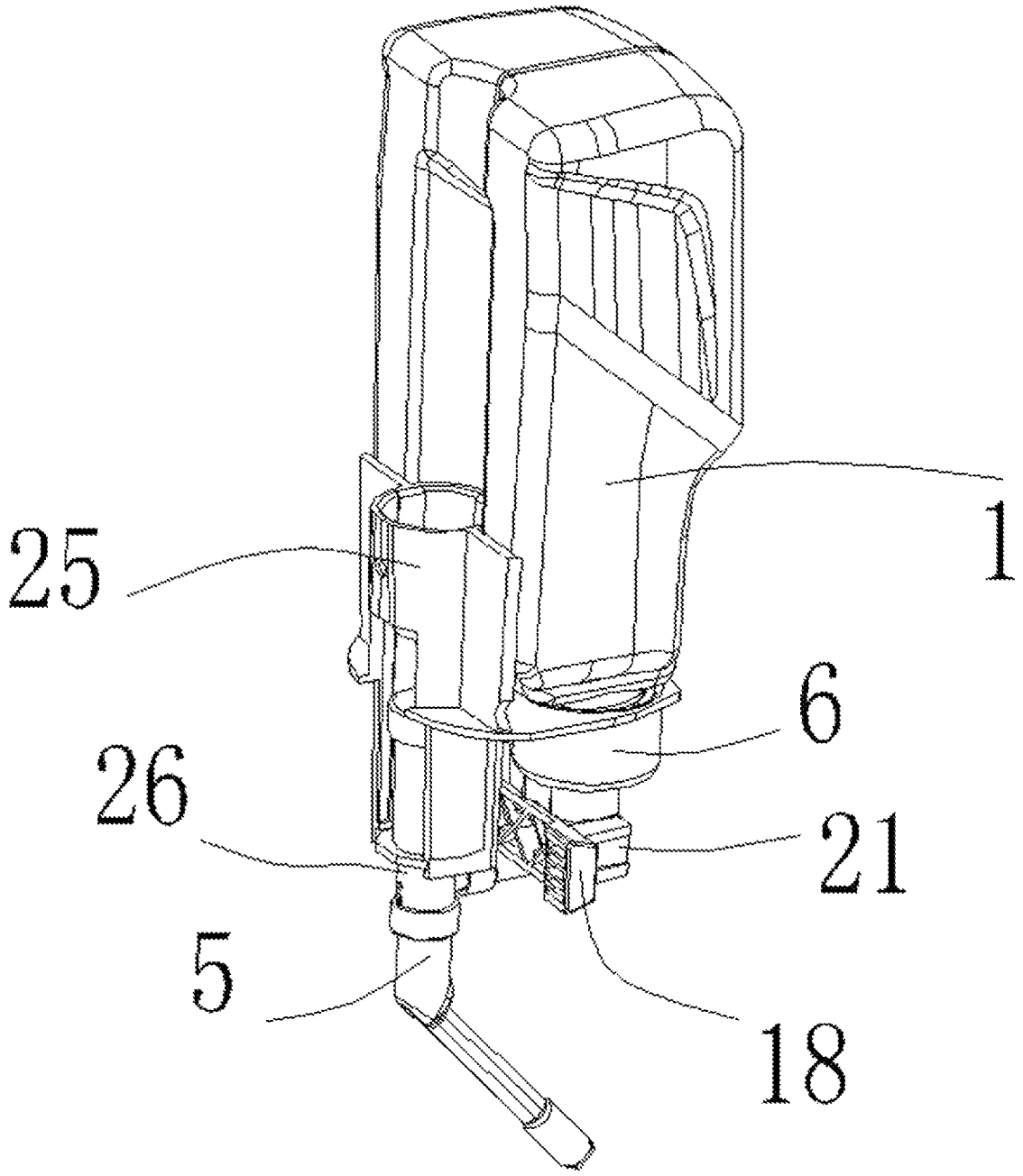
FIG. 3 is an internal structure diagram of the water tank from another angle of the present invention.
Figure 4:
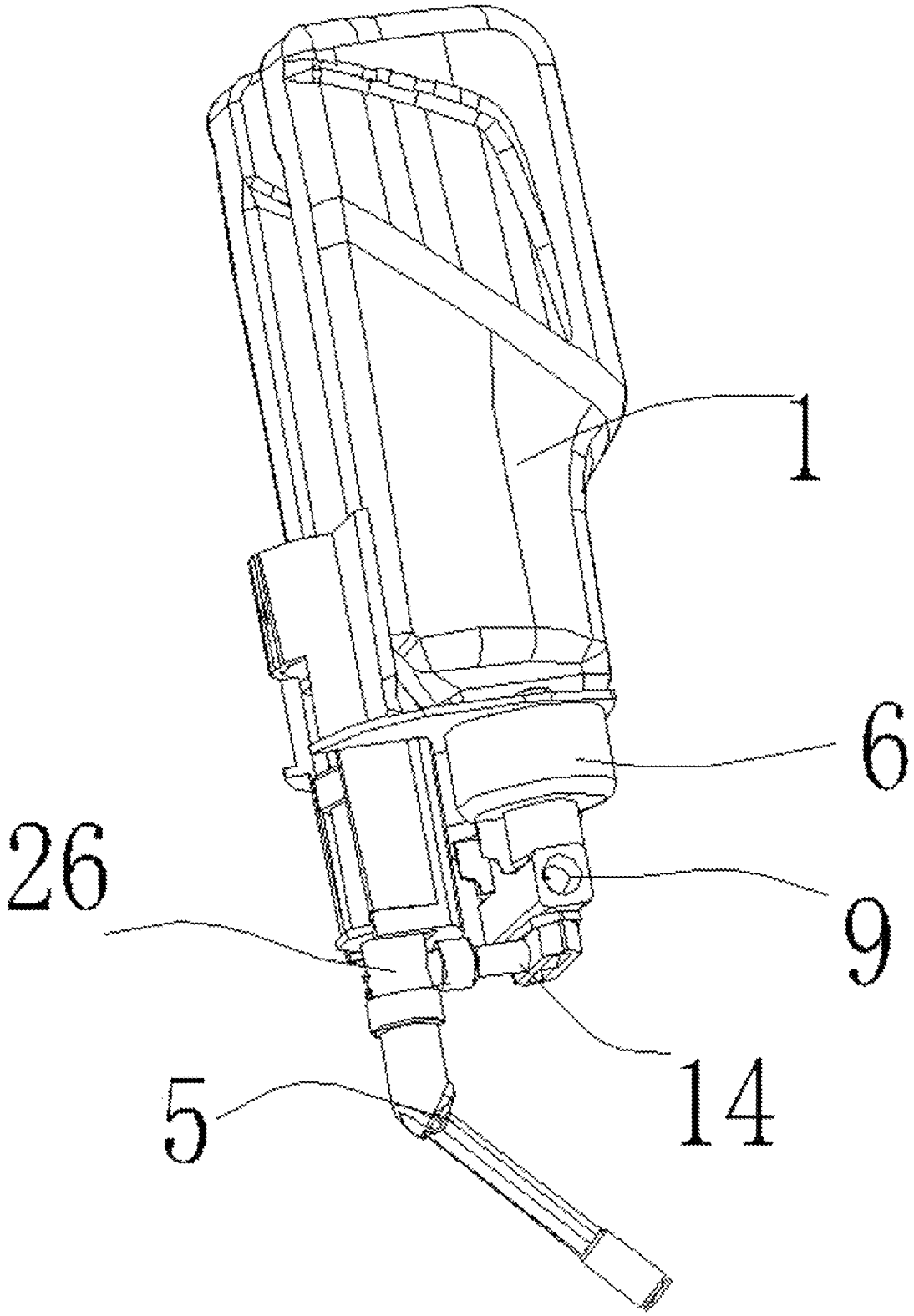
FIG. 4 is an internal structure diagram of the present invention in the water tank after a distribution valve is removed.
Figure 5:
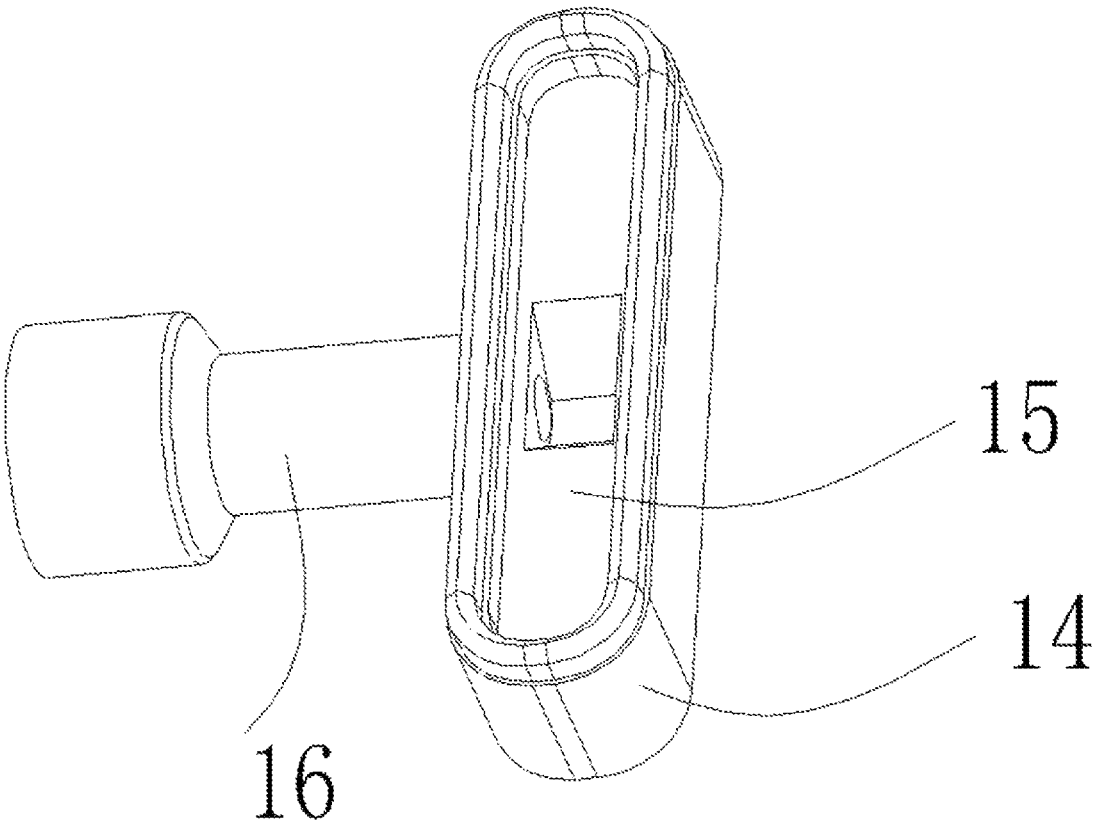
FIG. 5 is a schematic structural diagram of the connecting body.
Figure 6:
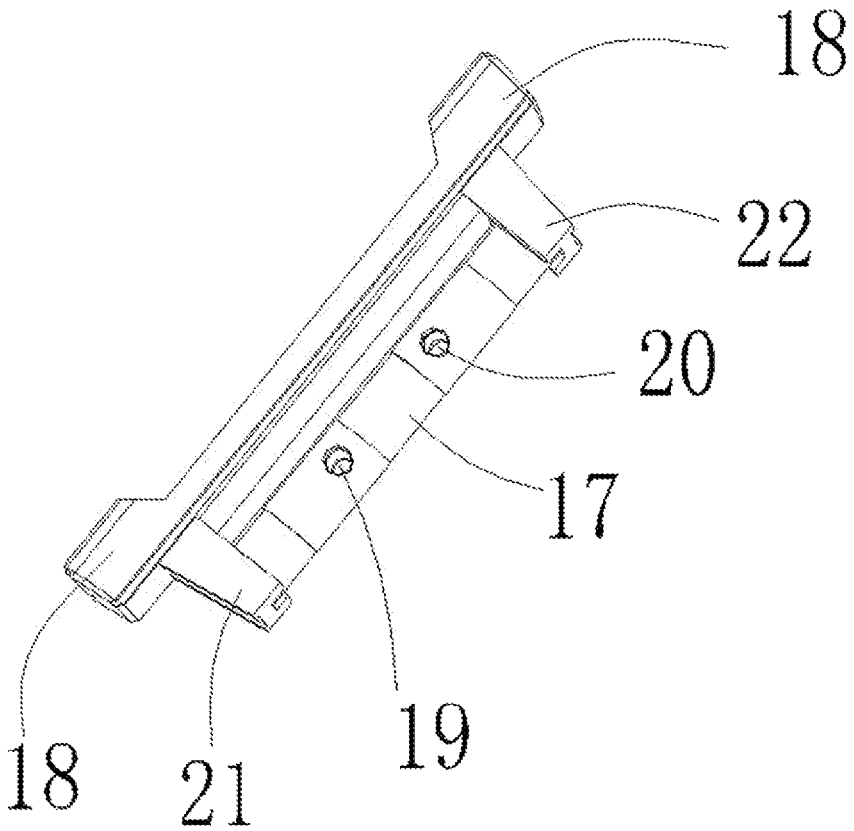
FIG. 6 is a schematic structural diagram of the distribution valve.
Figure 7:
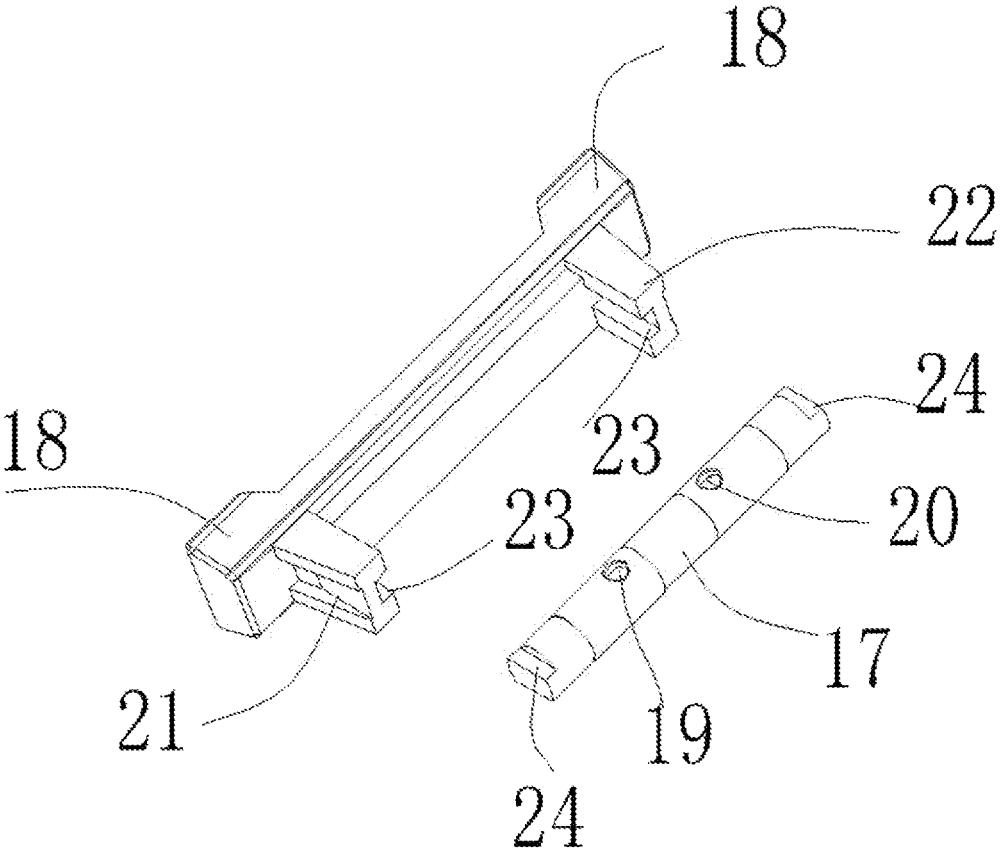
FIG. 7 is an exploded schematic diagram of the distribution valve.
Figure 8:
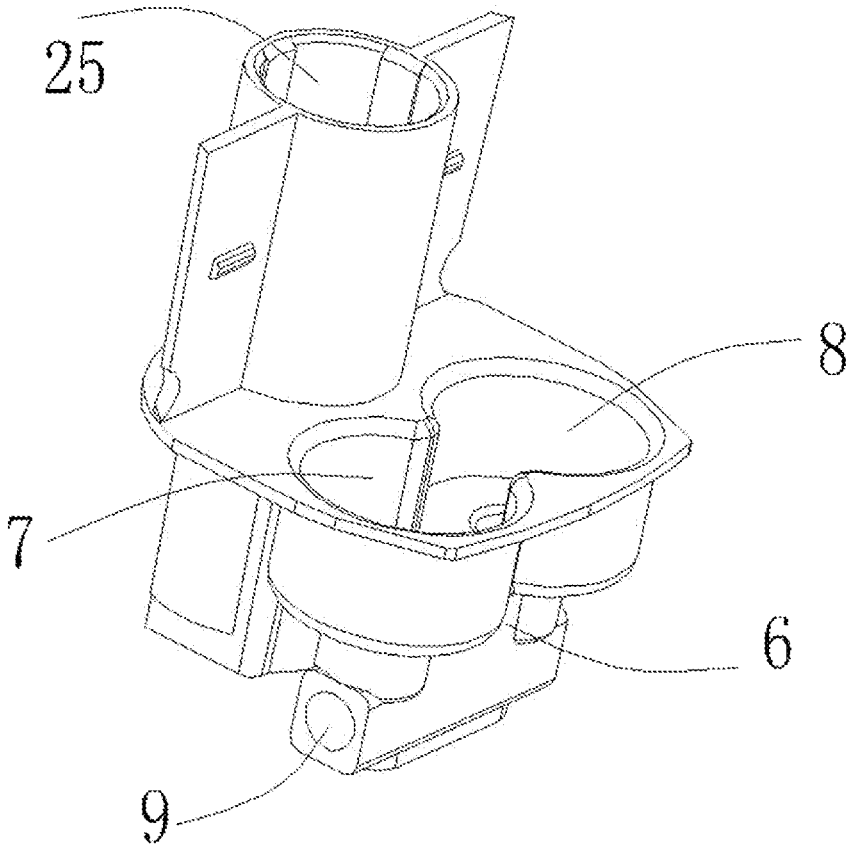
FIG. 8 is a schematic structural diagram of the distribution valve.
Figure 9:
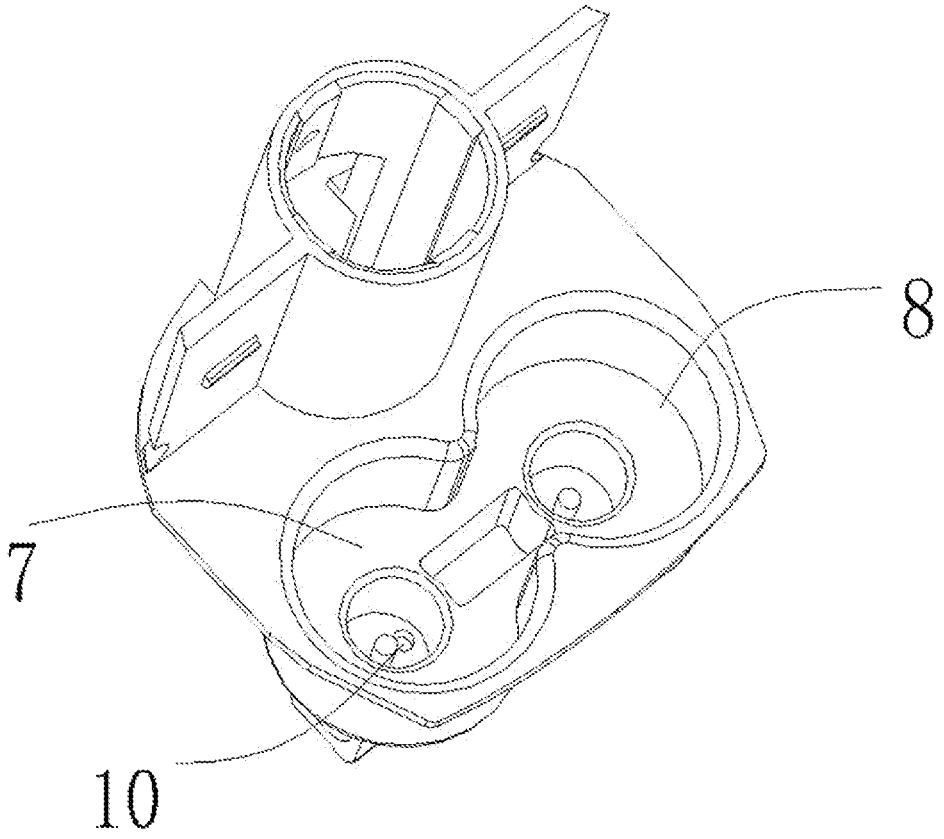
FIG. 9 is a schematic structural diagram of the distribution valve from another angle.
Figure 10:
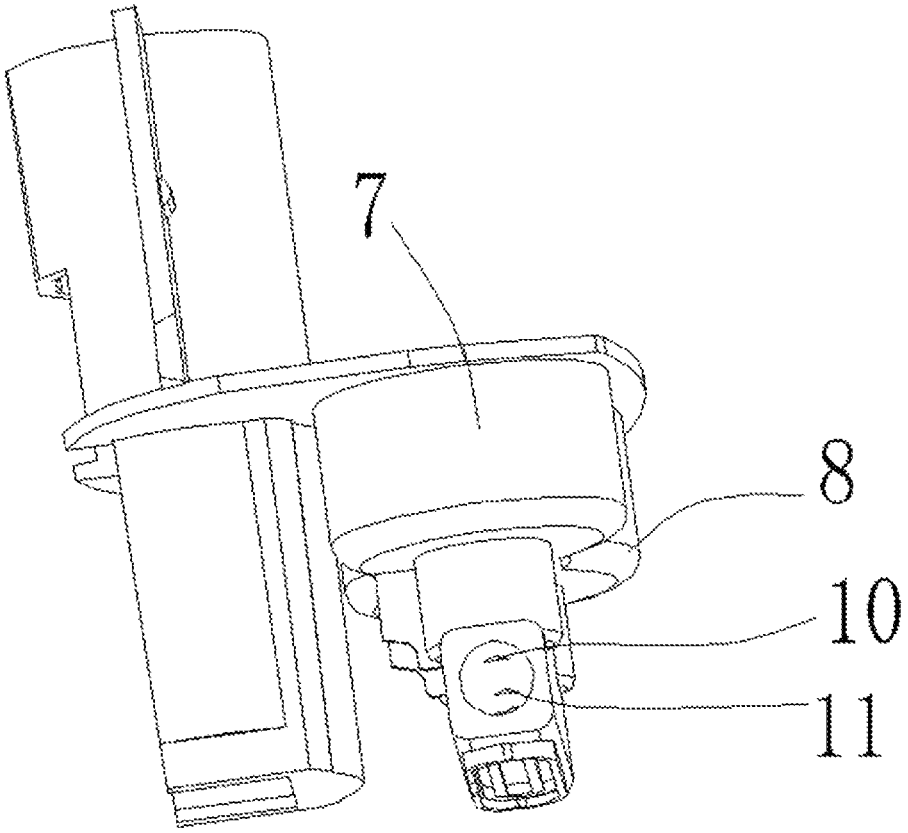
FIG. 10 is a schematic structural diagram of the distribution valve from another angle.
Figure 11:
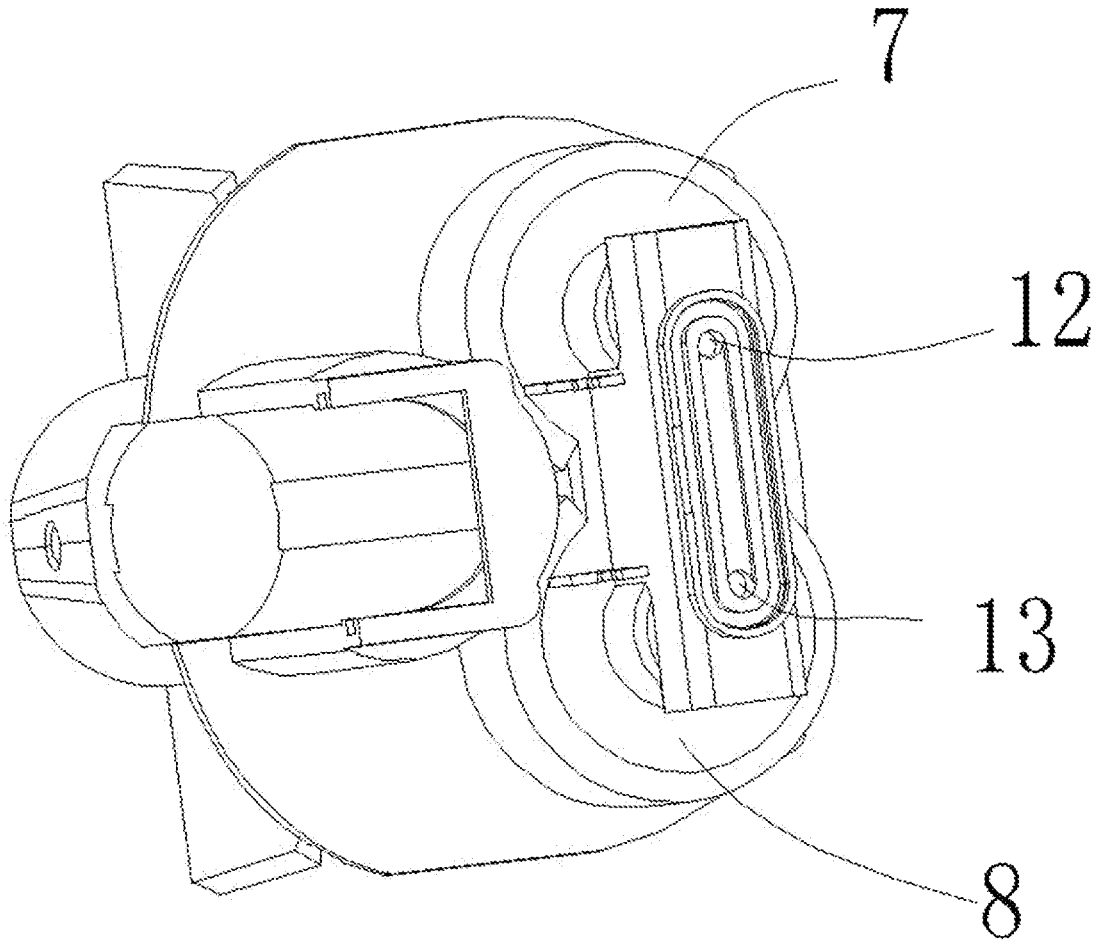
FIG. 11 is a schematic structural diagram of the distribution valve from another angle.

Referring to FIG. 1 and FIG. 11, a double-tank water spraying mop, including a mop rod 3, a water tank housing 4, a first water tank 1, a second water tank 2, a nozzle 5, and a distribution body 6, the first water tank 1, the second water tank 2, the water pump 26, the nozzle 5 and the distribution body 6 are located in the water tank housing 4, the water pump 26 is connected to the nozzle 5, after the water pump 26 is started, the liquid entering the water pump 26 from the first water tank land the second water tank 2 may be sprayed out through the nozzle 5.

A first groove 7 and a second groove 8 are defined at an upper end of the distribution body 6, a water outlet end of the first water tank 1 is placed in the first groove 7, and a water outlet end of the second water tank 2 is placed in the second groove 8, and the water pump 26 is connected with a lower part of the distribution body 6.

A distribution valve is further arranged in the distribution body 6, and under the distribution of the distribution valve, the liquid in the first water tank 1 and the second water tank 2 may flow into the water pump 26 through the distribution body 6.

The distribution body 6 is provided with a valve stem cavity 9, a bottom surface of the first groove 7 is provided with a first liquid inlet 10 for communicating the first groove 7 with the valve stem cavity 9, and a bottom surface of the second groove 8 is provided with a second liquid inlet 11 for communicating the second groove 8 with the valve stem cavity 9. A bottom surface of the distribution body 6 is provided with a first liquid outlet 12 and a second liquid outlet 13 which are opposite to the first liquid inlet 10 and the second liquid inlet 11 respectively. A lower end of the distribution body 6 is connected to a connecting body 14, which is connected to the water pump 26; the connecting body 14 is provided with a liquid passing cavity 15, the first liquid outlet 12 and the second liquid outlet 13 are communicated with the liquid passing cavity 15, and the liquid passing cavity 15 is communicated with the water pump 26 through a liquid passing pipeline 16.

The distribution valve includes a valve stem 17 and operating blocks 18 connected at both ends of the valve stem 17, and the operating blocks 18 at both ends may be integrated as shown in the figure or separated. The operating block 18 is exposed to the water tank housing 4, and the valve stem 17 is provided with a first channel 19 close to the first water tank 1, a second channel 20 close to the second water tank 2, the valve stem 17 passes through the valve stem cavity 9, and the valve stem 17 slides to communicate the first liquid inlet 10 with the first liquid outlet 12 through the first channel 19, or communicate the second liquid inlet 11 with the second liquid outlet 13 through the second channel 20. In case that the first channel 19 communicates the first liquid inlet 10 with the first liquid outlet 12, the liquid in the first water tank 1 may flow out of the liquid passing cavity 15 of the connecting body through the first liquid inlet 10, the first channel 19 and the first liquid outlet 12, and then flow to the nozzle 5, thus realizing the ejection of the liquid in the first water tank 1. In case that the second channel 20 communicates the second liquid inlet 11 with the second liquid outlet 13, the liquid in the second water tank 1 may flow out of the liquid passing cavity 15 of the connecting body through the second liquid inlet 11, the second channel 20 and the second liquid outlet 13, and then flow to the nozzle 5, thus realizing the ejection of the liquid in the second water tank 2.

In an embodiment, a first limit block 21 is arranged on the operation block 18 close to the first channel 19, and a second limit block 22 is arranged on the operation block 18 close to the second channel 20; in case that the valve stem 17 slides until the first limit block 21 abuts against the distribution body 6, the second channel 20 communicates the second liquid inlet 11 with the second liquid outlet 13, the operation block 18 with the second limit block 22 protrudes out of the water tank housing 4; Therefore, in case that the user observes the protrusion of the operation block 18, it is known that the second water tank 2 is in operation; in case that the valve stem 17 slides until the second limit block 22 abuts against the distribution body 6, the first channel 19 communicates the first liquid inlet 10 with the first liquid outlet 12, the operation block 18 with the first limit block 21 protrudes out of the water tank housing 4. Therefore, in case that the user observes the protrusion of the operation block 18, it is known that the first water tank 1 is in operation;

In an embodiment, an embedded groove 23 is defined on the operation block 18, and the two ends of the valve stem 17 are provided with embedded blocks 24, and the embedded blocks 24 slide into the embedded groove 23 to facilitate the assembly of the distribution valve.

In an embodiment, a rear part of the distribution body 6 is further provided with a rod connecting sleeve 25, and the mop rod 3 is inserted into the rod connecting sleeve 25.

In the description of this specification, descriptions referring to the terms "one embodiment", "some embodiments", "examples", "specific examples" or "some examples" mean that specific features, structures, materials or characteristics described in connection with this embodiment or example are included in at least one embodiment or example of the present invention. In this specification, the schematic expressions of the above terms do not necessarily refer to the same embodiment or example. Moreover, the specific features, structures, materials or characteristics described may be combined in any one or more embodiments or examples in a suitable manner.

The embodiments of the present invention have been described above. However, the present invention is not limited to the above embodiments. Any modification, equivalent substitution, improvement, etc. made within the spirit and principle of the invention should be included in the protection scope of the present invention.

What is claimed is:

1. A double-tank water spraying mop, comprising a mop rod, a water tank housing, a first water tank, a second water tank, a water pump, a nozzle, and a distribution body, wherein the first water tank, the second water tank, the water pump, the nozzle and the distribution body are located in the water tank housing, the water pump is connected to the nozzle, after the water pump is started, the liquid entering the water pump from the first and second water tanks may be sprayed out through the nozzle;

wherein a first groove and a second groove are defined at an upper end of the distribution body, a water outlet end of the first water tank is placed in the first groove, and a water outlet end of the second water tank is placed in the second groove, and the water pump is connected with a lower part of the distribution body;

wherein a distribution valve is further arranged in the distribution body, and under the distribution of the distribution valve, the liquid in the first water tank and the second water tank may flow into the water pump through the distribution body, wherein the distribution body is provided with a valve stem cavity, a bottom surface of the first groove is provided with a first liquid inlet for communicating the first groove with the valve stem cavity, and a bottom surface of the second groove is provided with a second liquid inlet for communicating the second groove with the valve stem cavity; a bottom surface of the distribution body is provided with a first liquid outlet and a second liquid outlet which are opposite to the first liquid inlet and the second liquid inlet respectively; a lower end of the distribution body is connected to a connecting body, which is connected to the water pump; the connecting body is provided with a liquid passing cavity, the first liquid outlet and the second liquid outlet are communicated with the liquid passing cavity, and the liquid passing cavity is communicated with the water pump;

wherein the distribution valve comprises a valve stem and an operation block connected to both ends of the valve stem, which is exposed out of the water tank housing, the valve stem is provided with a first channel close to the first water tank and a second channel close to the second water tank, the valve stem penetrates through the valve stem cavity, the valve stem slides and communicates the first liquid inlet with the first liquid outlet through the first channel, or communicates the second liquid inlet with the second liquid outlet through the second channel;

wherein a first limit block is arranged on the operation block close to the first channel, and a second limit block is arranged on the operation block close to the second channel; wherein in case that the valve stem slides until the first limit block abuts against the distribution body, the second channel communicates the second liquid inlet with the second liquid outlet, the operation block with the second limit block protrudes out of the water tank housing; wherein in case that the valve stem slides until the second limit block abuts against the distribution body, the first channel communicates the first liquid inlet with the first liquid outlet, the operation block with the first limit block protrudes out of the water tank housing.

2. The double-tank water spraying mop according to claim 1, wherein an embedded groove is defined on the operation block, and the two ends of the valve stem are provided with embedded blocks, and the embedded blocks slide into the embedded groove.

3. The double-tank water spraying mop according to claim 1, wherein a rear part of the distribution body is further provided with a rod connecting sleeve, and the mop rod is inserted into the rod connecting sleeve.

* * * * *